United States Patent [19]

Ratchford

[11] 4,094,391

[45] June 13, 1978

[54] SUITCASE WITH WHEELS AND TRANSPORTING HOOK

[76] Inventor: Debrilla M. Ratchford, 1900 S. Eads St., Arlington, Va. 22202

[21] Appl. No.: 788,529

[22] Filed: Apr. 18, 1977

[51] Int. Cl.[2] ..... A45C 13/26

[52] U.S. Cl. ..... 190/18 A; 190/58 A; 190/60; 224/45 T; 280/47.17; 294/26

[58] Field of Search ..... 190/18 R, 18 A, 60, 190/58 A; 294/15, 26; 280/47.17; 224/45 T, 45 W, 45 P; 16/115

[56] References Cited

U.S. PATENT DOCUMENTS

| | | | |
|---|---|---|---|
| 608,172 | 8/1898 | Botulinski | 294/26 |
| 687,889 | 12/1901 | Kulp | 294/26 X |
| 1,710,575 | 4/1929 | Grant | 294/26 |
| 2,437,405 | 3/1948 | Robinson | 190/58 A UX |
| 2,882,084 | 4/1959 | Eatinger | 294/26 |
| 3,257,120 | 6/1966 | Browning | 190/18 A X |
| 3,708,197 | 1/1973 | Snell | 294/26 |
| 3,805,929 | 4/1974 | Kuwayama | 190/18 A |
| 3,861,703 | 1/1975 | Gould | 190/18 A X |
| 3,958,731 | 5/1976 | Riedle | 190/60 X |

FOREIGN PATENT DOCUMENTS

| | | | |
|---|---|---|---|
| 56,720 | 5/1924 | Sweden | 294/26 |

*Primary Examiner*—Donald F. Norton
*Attorney, Agent, or Firm*—James C. Wray

[57] ABSTRACT

A long, bent hook and a set of detachable wheels are used to transport luggage. The housing for the wheels is attached to a suitcase by means of a self-adhesive plate. The wheel axles are spring loaded so they can be taken off. The hook incorporates a metal rod bent 270° at one end to form a handle and a perpendicularly bent J-shaped hook at the other end that is used for holding one or more bags. Furthermore, the metal rod is again bent about a third of the way from the handle to the hook.

15 Claims, 10 Drawing Figures

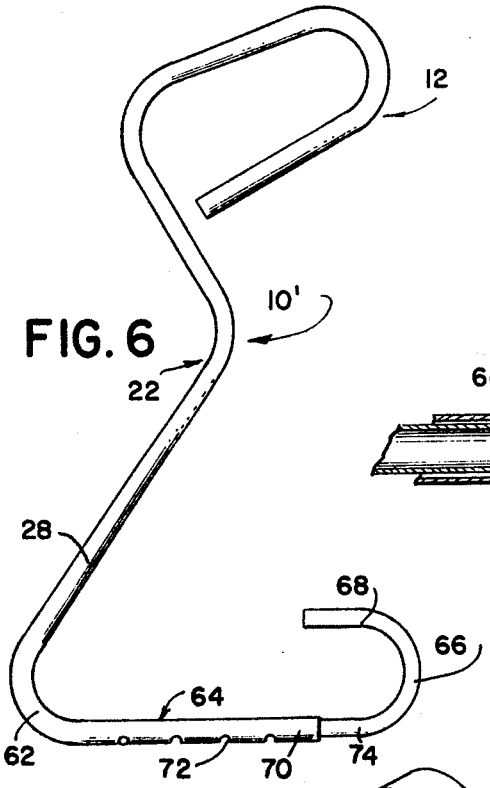
FIG. 6
FIG. 7
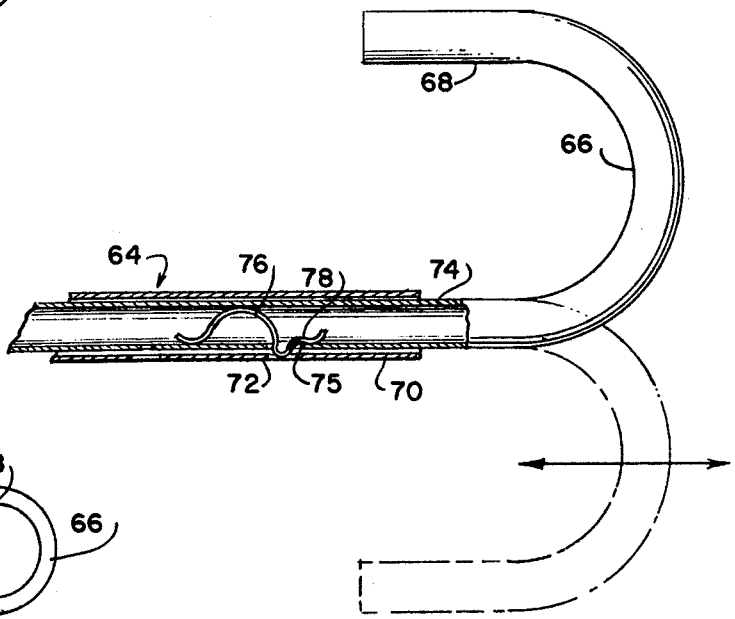
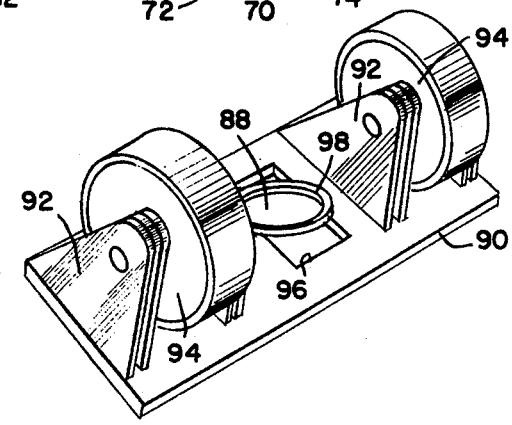
FIG. 9
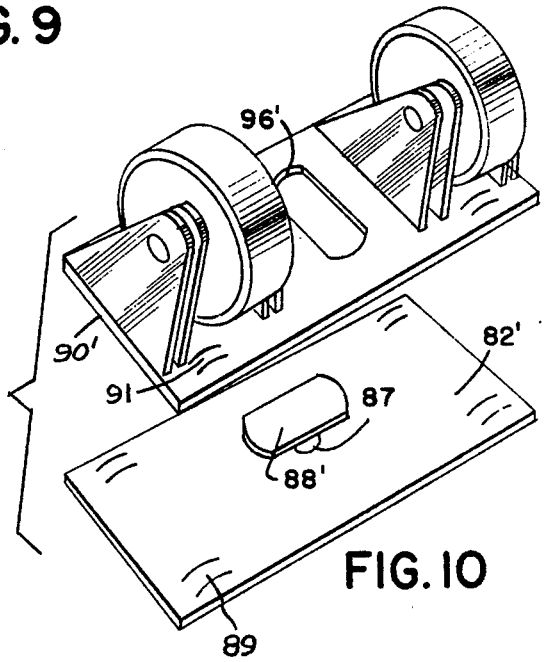
FIG. 10
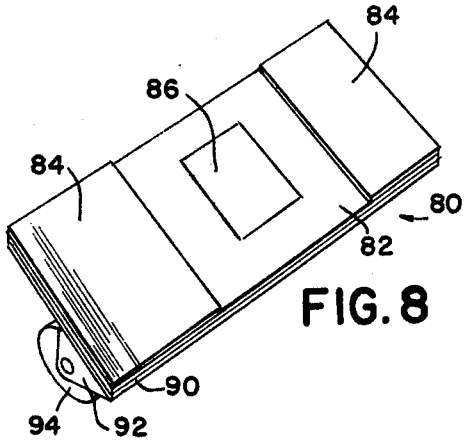
FIG. 8

SUITCASE WITH WHEELS AND TRANSPORTING HOOK

BACKGROUND OF THE INVENTION

This invention relates to luggage supporting devices and more particularly has reference to a portable suitcase attaching hook and wheels device capable of simply and easily transporting more than one bag at a time.

DESCRIPTION OF THE PRIOR ART

Examples of pertinent patents ar U.S. Pat. Nos. 1,616,632, 2,925,283, 2,999,310 and 3,257,120 and Swedish Pat. No. 56,720.

U.S. Pat. No. 1,616,632 shows a luggage carrier comprised of mounted wheels and a sectional extensible handle which may be removably attached to the carrier by means of a threaded extension and socket. The wheels are mounted on arms that are secured to the bag.

U.S. Pat. No. 2,925,283 described a self-contained means for rolling luggage along the ground. The wheels are retractable and mounted as an integral part of the suitcase structure. A U-shaped handle slides into supports on the sides of the suitcase.

U.S. Pat. No. 3,257,120 described handle and wheels which are bolted to a suitcase. In all of these cases the inventions are designed to transport one suitcase.

In U.S. Pat. No. 2,999,310, FIG. 3 shows a holding tool comprising a metal rod having a handle portion and curved end formed as a hook. The design and function are substantially different from the present hook.

Swedish Pat. No. 56,720 covers a hook with an oval shaped handgrip. The body portion and hook are different.

None of the prior art devices provides a means for a traveler to handle more than one bag at a time. In addition, none of the prior art devices' wheels are readily detachable from the luggage.

SUMMARY OF THE INVENTION

The present invention overcomes the problems which exist in the prior art devices. The present invention provides a long J-shaped hook that can support more than one piece of luggage at a time. The invention also incorporates a set of wheels which are detachably connected to luggage supported by the hook.

In a preferred form, the invention provides a luggage hook designed to engage the handles on suitcases. The hook incorporates a U-shaped handle, a J-shaped suitcase support hook, and a shank connecting the handle and support hook. Preferably, the handle, the support hook and the shank are cast integrally. The support hook is sufficiently long to engage the handles on a plurality of suitcases arranged in a row. The shank is bent out of line near the handle to enable convenient gripping of the handle and tilting of the luggage engaged by the luggage hook.

In a preferred embodiment, the invention further provides a pair of detachable wheel brackets which are attached to the bottom of a suitcase by means of an adhesive plate.

Preferably, the wheels have split, spring-loaded axles so that they can be removed from the wheel brackets.

In preferred use, one set of wheels is attached to the bottom of the first suitcase in a group engaged by the luggage hook. The traveler then grips the handle on the hook and pulls it toward himself to tilt the first suitcase on the wheels. By continued pulling of the handle as he walks, the traveler moves all the luggage engaged by the hook simultaneously.

One object of the invention is the provision of a luggage transport apparatus having a suitcase engaging hook having a handle, a support member configured to engage suitcases, a shank connecting the handle and support member, the support member comprising a relatively long portion having first and second ends, the first ends connected to the shank at an angle, retaining means connected to the second end for preventing accidental removal of suitcases from the support member, wheel carrier assemblies connected to suitcases engaged by the suitcase engaging hook, and wheel assemblies rotatably supported by the wheel carrier assemblies.

Another object of the invention is the provision of a luggage transport apparatus wherein the shank connected to the handle is bent out of line with the shank portion connected to the support member at an angle sufficient to enable convenient gripping of the handle during use.

Still another object is to provide a luggage transport apparatus wherein the relatively long portion of the support member is sufficiently long to simultaneously engage a plurality of suitcases arranged along the support member.

A further object is the provision of a luggage transport apparatus wherein the wheel carrier assemblies are removably connected to suitcases engaged by the suitcase engaging hook.

Yet another object is the provision of a luggage transport apparatus wherein the wheel assemblies are removably supported by the wheel carrier assemblies.

Another object of the invention is the provision of a luggage transport curved handle wherein the luggage support member comprises a telescoping extensible support member with detent means for holding the support member at its desired position of extension.

A further object of the invention is the provision of a suitcase wheel assembly wherein the wheel carrier assemblies include bases for permanent attachment to the suitcase and spaced wheels on plates, and means on the bases and plates for removably connecting the bases and plates so that the wheels are connected to a bottom of a suitcase.

These and other and further objects and features of the invention are apparent in the disclosure which includes the above and below specification and claims and drawings.

BRIEF DESCRIPTION OF THE DRAWINGS

FIG. 6 is an elevational view of a suitcase hook with an expandable suitcase support member.

FIG. 7 is a detail of the telescoping expandable suitcase member and detent.

FIG. 8 is a detail of a removable wheel assembly having spaced adhesive pads for connection to an underside of a suitcase.

FIG. 9 is a detail of a removable wheel assembly showing a central means on the plate for connection to a base mounted on a suitcase.

FIG. 10 is an exploded view of a base for mounting on a suitcase and a wheel assembly having a tape configured for connecting to the base.

DETAILED DESCRIPTION OF THE DRAWINGS

Figure 2:
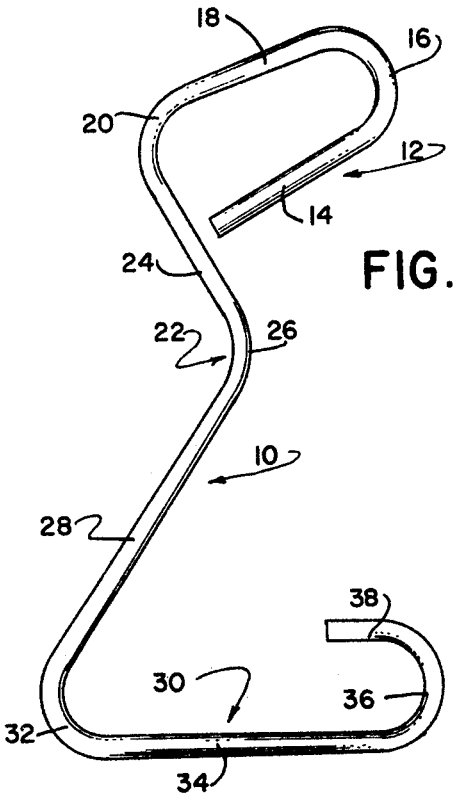
FIG. 2 is a side elevational view of the suitcase engaging hook of the present invention.

Referring to FIG. 2, a suitcase engaging hook 10 made in accordance with one embodiment of the present invention is shown to include a handle 12, a J-shaped support member 30, and a shank 22 connecting the handle 12 and support member 30. The handle 12, shank 22 and support member 30 are cast integrally.

The handle 12 is formed generally into a U-shape with a curved portion 16 and parallel legs 14 and 18 extending from each end of the curved portion 16. The upper leg 18 is connected to the upper end portion 24 of the shank 22 by a perpendicularly curved portion 20. The space between the legs 14 and 18 is sufficiently large to enable the user's fingers to fit between the legs 14 and 18 and close around the upper leg 18. Similarly, the upper leg 18 is sufficiently long to accommodate the entire width of the user's hand. The handle 12 thereby provides a comfortable, efficient and easily manufactured means for the user to grip the suitcase engaging hook 10.

Figure 1:
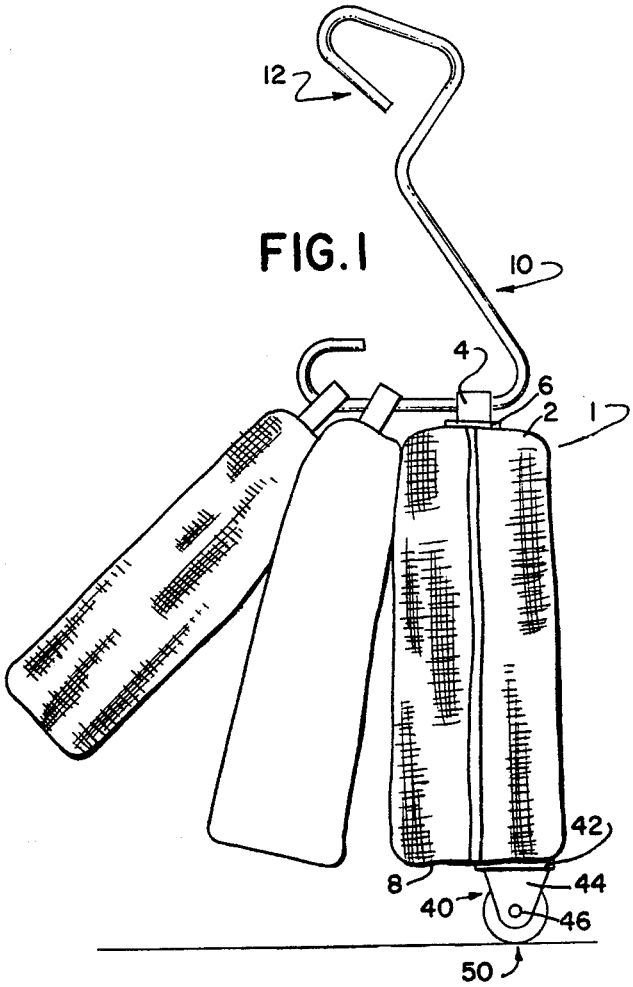
FIG. 1 is a side elevational view of the suitcase engaging hook and wheels of the invention in use transporting luggage.

The support member 30 is formed generally into a J-shape with a curved portion 36, a short leg 38 extending from the upper end of the curved portion 36 and a long leg 34 extending from the lower end of the curved portion 36. The end of the lower leg 34 is connected to the lower end portion 28 of the shank 22 by an acutely bent, curved portion 32. The space between the two legs 34 and 38 is sufficiently small to enable the user to project the curved portion 36 and legs 34 and 38 through the hand opening in a handle 4 connected to the top of a suitcase 2. See FIG. 1. The user simply rotates the hook 10 until the curved portion 36 is sufficiently horizontal to enable it to project through the handle 4. As shown in FIG. 1, the hook 10 is rotated back to a vertical operation position once the short upper leg 38 projects entirely through the handle 4. This allows the handle 4 to rest on the long lower leg 34. The suitcase 4 is then supported by the long leg 34 when the hook 10 is lifted vertically by the user.

As shown by FIG. 1, the long leg 34 is sufficiently long to accommodate a plurality of suitcases simultaneously. The user simply arranges his luggage so that the handles 4 are aligned. He then rotates the hook 10 as described above and projects the curved portion 36 of the support member 30 through handles consecutively. When the short leg 38 has passed through all the handles in the arrangement, the user rotates the hook 10 back to a vertical position. Vertical lifting of the hook 10 will then lift all the suitcases in the arrangement simultaneously. The short leg 38 and curved portion 36 of the support member 30 prevent the suitcases supported by the support member 30 from accidentally sliding off the suitcase engaging hook 10.

Referring again to FIG. 2, the shank 22 is shown to be bent out of line 26 at between the upper end portion 24 and the lower end portion 28. The bend 26 enables the user to grip the handle 12 while standing at the end of a row of suitcases engaged by the hook 10 as shown in FIG. 1 and to easily pull the handle 12 toward himself, there tilting the suitcase 2 nearest himself and raising the remaining suitcases above the ground. The bend 26 is at an appropriate angle so that the wrist on the user's hand gripping the handle 12 is comfortably straight when the suitcase 4 is properly tilted for most efficient transportation.

Figure 3:
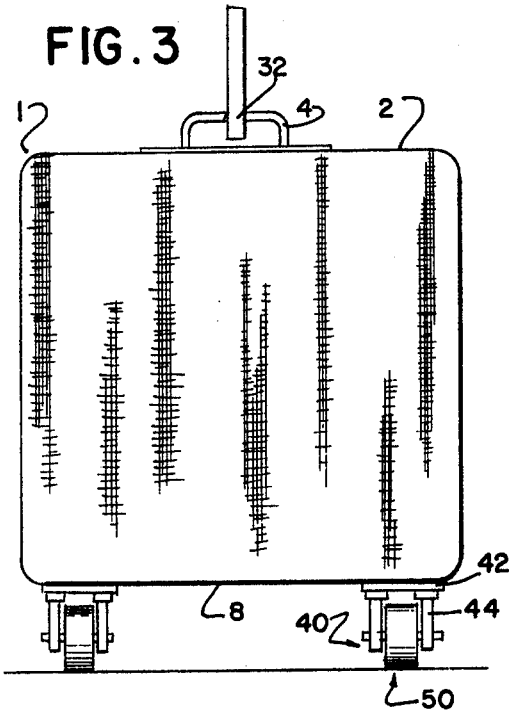
FIG. 3 is a fragmentary rear elevation of the lower portion of the invention in use as shown in FIG. 1.
Figure 4:
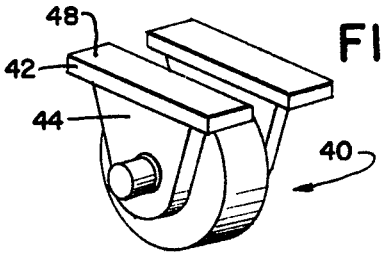
FIG. 4 is a perspective view of the wheel carrier assembly and wheel assembly of the present invention shown in FIGS. 1 and 3.
Figure 5:
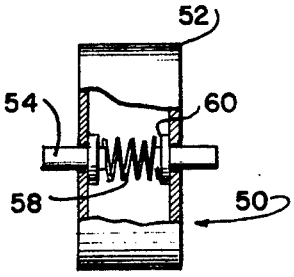
FIG. 5 is a front elevation, partially in section of the wheel assembly shown in FIGS. 1, 3 and 4.

In order to further facilitate transportation of the luggage, the invention provides a set of detachable wheel brackets 40 and detachable wheels 50. As shown in FIGS. 1 and 3, the brackets 40 are attached to the bottom 8 of the first suitcase 2 engaged by the hook 10 in the procedure described above. This enables the user to wheel the entire group of luggage simply by gripping the handle 12 on the hook 10, tilting the luggage as described above, and walking in the desired direction while constantly exerting a horizontal force on the handle 12. It is clear that the user can walk in a direction toward the luggage while constantly pushing the handle 12 away from himself or walk away from the luggage while constantly pulling the handle toward himself. It is also clear the luggage can be turned in an arc about either wheel simply by the user's exerting the appropriate sideways force on the handle 12.

The wheel brackets 40 have horizontally spaced vertical struts 44 with openings positioned to receive wheel axles 54. A horizontal plate 42 is connected to the upper end of each vertical strut 44. Adhesive material is attached to the upper surface 48 of the plate 42 which cooperates with the bottom 8 of the properly located suitcase 2 to removably attach the bracket 40 to the suitcase. The detachable wheels 50 are configured to removably mount on the wheel brackets 40. Each wheel 50 has an outer housing with a rolling surface 52. Opposed wheel axles 54 project through horizontally aligned openings in the center of each side of the housing 52. A spring 58 is connected to retaining plates 60 mounted on the inner ends of the axles 54. The openings 52 are sufficiently large to enable the axles 54 to project into the interior of the housing when the outer ends of th axles 54 are pushed toward the housing. However, the openings are small enough to prevent passage of the retaining plates 60 through the openings.

To mount the wheels 50 on the brackets 40, the user simply pushes the outer ends of both axles 54 toward the housing 52 simultaneously. He then aligns the axles 54 with the openings in the vertical struts 44 and releases the axle 54 ends. The spring 58 forces the outer ends of the axles 54 away from the housing 52 and projects them through the strut 44 opening. The strut 44 opening is large enough to permit rotation of the axles 54 after the wheels 50 are mounted. The space between the struts 44 is sufficiently large to accommodate the wheel housing 52 and to permit the housing to freely rotate.

The detachability feature of the wheels 50 and wheel brackets 40 enables the user to carry luggage with the hook 10 whenever doing so would be more convenient than wheeling it. Such would occur, for example, if a group of luggage was relatively light and few in number but rather clumsy to manipulate by hand owing to their assorted sizes. In such an instance, the user need simply use the hook 10 in the manner described above to engage and simultaneously lift the entire group of luggage and conveniently carry it to the desired destination. If he is in a hurry, he need not spend time attaching the wheels 50 and brackets 40. If he needs to merely carry the luggage up a flight of stairs, he may prefer to dispense with wheels that could prove bothersome or dangerous in such an undertaking.

An expandable embodiment of the luggage hook 10' is shown in FIG. 6. The hook has a handle portion 12 and a shank portion 22 similar to the hook shown in FIG. 2. The curved part 62 at the bottom of the shank portion 22 is integrally formed with a luggage support member 64 which also has a rigidly attached hook 66 and a reentrant end 68. The expandable telescopic luggage support member 64 is formed from an outer tube 7.

The large tube 70 has a series of holes 72 in its bottom which receive a curved end 78 of spring 76 as shown in FIG. 7. The small tube 74 fits within the large tube and has a hole 75 through which the end 78 projects. To adjust the length of the support member 64 one grips hook 66 and curve 62 and pulls slightly outward to cause bead 78 to ride up in hole 72 to the inner surface of tube 70. Twisting the hook in the manner shown in FIG. 7 removes the bead 78 from the series of holes 72.

Further longitudinal movement in the direction of the arrow shown in FIG. 7 adjusts the hook to the desired length whereupon the hook is again turned upward and aligned with the plane of the handle and is moved slightly foreward or rearward to cause the bead 78 to drop into one of the holes 72.

As shown in FIG. 8, a preferred form of wheel mounting 80 has an upper plate 82 with spaced permanent adhesive portions 84 for permanent fixture to a suitcase. 86 represents the top of a bolt which has been permanently embedded in plate 82.

Lower plate 90 has parallel struts 92 which extend downward to rotatably support wheels 94.

As shown in FIG. 9, bolt 88, having a head 86 attached to an upper plate is received within opening 96 in the wheel plate, and a nut 98 is threaded onto the bolt to attach the wheel plate 90 to the base 82. When traveling, nut 98 may be removed, and bolt 88 acts as one of the downward extending lugs conventionally associated with a bottom of the suitcase to squarely support the suitcase in standing position.

An alternate embodiment of the invention is shown in FIG. 10 where a plate 82' which is permanently attached to a suitcase has a stem 87 which supports fastener 88'. Rounded humps 89 fit within depression 91 to hold the plate 90' in alignment with base 88' when the plate and base have been connected.

Connecting the wheels to the fastener 88' requires putting the wheel assembly 90' at right angles to the base 82' and aligning opening 96' with fastener 88', pushing the wheel assembly downward and twisting the wheel assembly so that the rounded humps 89 engage the depressions 91 in the plate 90'.

When the wheel assembly is removed and packed in the suitcase for traveling, the stud 87 and fastener 88 prime act in cooperation with conventional lugs on the bottom of the suitcase to hold the suitcase in square upright position.

While the invention has been described with specific reference to embodiments, modifications and variations of the invention may be constructed without departing from the scope of the invention. The scope of the invention is defined in the following claims.

What is claimed is:

1. A suitcase engaging hook having a handle, a support member configured to engage suitcases, a shank connecting the handle and support member, the support member comprising a relatively long portion having first and second ends, the first end connected to the shank at an angle, retaining means connected to the second end for preventing accidental removal of suitcases from the support member, wheel carrier assemblies connected to a suitcase engaged by the suitcase engaging hook, and wheel assemblies rotatably supported by the wheel carrier assemblies.

2. The apparatus of claim 1 wherein the retaining means comprises a substantially U-shaped member having the end of one leg connected to the second end of the relatively long portion of the support member and the other leg positioned outward from the support member in substantially the same direction as the shank.

3. The apparatus of claim 1 wherein the handle comprises an extended portion having first and second ends, the first end connected to the shank and extending substantially perpendicular to the shank, the second end being curved substantially into a U-shape in substantially the same direction as the shank, the extended portion formed integrally with the shank.

4. The apparatus of claim 1 wherein the first end of the relatively long portion of the support member is connected to the shank at an acute angle.

5. The apparatus of claim 4 wherein the shank portion connected to the handle is bent out of line with the shank portion connected to the support member in a direction away from the support member at an angle sufficient to enable convenient gripping of the handle during use.

6. The apparatus of claim 1 wherein the shank portion connection to the handle is bent out of line with the shank portion connected to the support member at an angle sufficient to enable convenient gripping of the handle during use.

7. The apparatus of claim 1 wherein the support member is configured to engage handles on suitcases, thereby supporting the suitcases.

8. The apparatus of claim 1 wherein the relatively long portion of the support member is sufficiently long to simultaneously engage a plurality of suitcases arranged along the support member.

9. The apparatus of claim 1 wherein the wheel carrier assemblies are removably connected to a suitcase engaged by the suitcase engaging hook.

10. The apparatus of claim 9 wherein the wheel carrier assemblies comprise an adhesive plate removably adhered to the suitcase, thereby removably connecting the wheel carrier assemblies and the suitcase.

11. The apparatus of claim 1 wherein the wheel assemblies are removably supported by the wheel carrier assemblies.

12. The apparatus of claim 11 wherein the wheel carrier assemblies comprise brackets connected to a suitcase engaged by the suitcase engaging hook, horizontally spaced vertical struts connected to each bracket having horizontally aligned openings to accommodate wheel axles, and the wheel assemblies comprise pairs of opposed wheel axles, relatively large plates connected to opposing axles at the ends in opposition, springs connecting opposing plates, wheels mounted in surrounding relation to the pairs of opposed wheel axles, the wheels comprising housings formed about the wheel axles sufficiently large to accommodate the opposing plates and springs, the housings having horizontally spaced side walls, axially opposed openings in the side walls of diameter slightly larger than the diameter of the axles, divergent ends of opposing axles projecting through axially opposed openings.

13. The apparatus of claim 1 wherein the wheel carrier assemblies comprise bases for permanent attachment to the suitcase and spaced wheels on plates, and means on the bases and plates for connecting the bases and plates so that the wheels are connected to a bottom of a suitcase.

14. Luggage transport apparatus comprising a suitcase engaging hook having a handle, a support member configured to engage suitcases, a shank connecting the handle and support member, the support member comprising a relatively long portion having first and second ends, the first end connected to the shank at an angle, retaining means connected to the second end for preventing accidental removal of suitcases from the support member, and the relatively long portion made sufficiently long to simultaneously engage a plurality of suitcases arranged along the support member, wherein the support member comprises a telescoping extensible support member with detent means for holding the support member at its desired position of extension.

15. The apparatus of claim 14 wherein the first end of the relatively long portion of the support member is connected to the shank at an acute angle and the shank portion connected to the handle is bent out of line with the shank portion connected to the support member in a direction away from the support member at an angle sufficient to enable convenient gripping of the handle during use.

* * * * *